US006236024B1

(12) United States Patent
Gotz et al.

(10) Patent No.: US 6,236,024 B1
(45) Date of Patent: May 22, 2001

(54) COOKTOP OR STOVE HAVING AN ARRANGEMENT OF A ONE-PIECE MOLDED PART MADE OF GLASS CERAMIC, GLASS OR CERAMIC IN THE COOKING SURFACE AREA OF THE COOKING UNIT IN A CUTOUT OF A SILL PLATE

(75) Inventors: Helga Gotz, Mainz; Stefan Hubert, Bubenheim; Karl-Heinz Juras; Hubertus-Christian Bader, both of Mainz, all of (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 09/425,426

(22) Filed: Oct. 22, 1999

(30) Foreign Application Priority Data

Oct. 23, 1998 (DE) ..... 198 48 908

(51) Int. Cl.[7] ..... H05B 3/68; F24C 3/00
(52) U.S. Cl. ..... 219/452.11; 126/39 H
(58) Field of Search ..... 219/451.1, 452.11, 219/452.12, 460.1; 126/39 H, 39 N, 39 J, 90 A, 92 A

(56) References Cited

U.S. PATENT DOCUMENTS 5,357,079 * 10/1994 Henry et al. ..... 219/452.12
5,432,320 * 7/1995 Scheidler et al. ..... 219/452.12
5,528,015 * 6/1996 VonBlanquet et al. ..... 219/452.12
5,530,224 * 6/1996 Sassman ..... 219/452.12
5,549,100 * 8/1996 Heisner ..... 126/39 J

FOREIGN PATENT DOCUMENTS 2647156 4/1978 (DE) .
3009961 9/1981 (DE) .
3227058 1/1984 (DE) .
9013064 1/1991 (DE) .
4216677 11/1993 (DE) .
4333334 4/1995 (DE) .
9418476 4/1995 (DE) .
297 02 586 U 5/1997 (DE) .
19610073 9/1997 (DE) .
29521593 11/1997 (DE) .
298 11 628 U 6/1998 (DE) .
0860660 8/1998 (EP) .
2296088 6/1996 (GB) .

* cited by examiner

*Primary Examiner*—Sang Paik
(74) *Attorney, Agent, or Firm*—Nils H. Ljungman & Associates

(57) ABSTRACT

An arrangement of a one-piece molded part made of glass ceramic, glass or ceramic is used as the cooking surface of a cooking unit in a cutout of a sill plate. The molded part has an elevated, encircling outer peripheral region that is different from the level of the inner main level of the one-piece molded part, in which at least one cooking zone is located. The one-piece molded part is inserted substantially flush into the cutout of the sill plate or is laid by means of its encircling peripheral area on the edge of the cutout of the sill plate.

20 Claims, 2 Drawing Sheets

COOKTOP OR STOVE HAVING AN ARRANGEMENT OF A ONE-PIECE MOLDED PART MADE OF GLASS CERAMIC, GLASS OR CERAMIC IN THE COOKING SURFACE AREA OF THE COOKING UNIT IN A CUTOUT OF A SILL PLATE

BACKGROUND OF THE INVENTION

1. Field of the Invention

The present invention relates to the arrangement of a one-piece molded part made of glass ceramic, glass or ceramic as a cooking surface of a cooking unit in a cutout of a sill plate, with an encircling outer peripheral area that is elevated from the level of the inner main plane.

2. Background Information

The flush installation of flat cooking surfaces made of glass ceramic in a cutout of a sill plate may be described in some publications.

In other words, a sill plate may be described as a work space that surrounds a cooking surface and that separates the cooking surface from the remainder of a kitchen counter top.

German Patent Publication No. 30 09 961 C2, for example, describes an installation frame that is connected with a cutout of a sill plate, on which a flat glass ceramic cooktop unit lies on the sill plate, flush with the cutout. By using appropriate screws, it is possible to adjust the height of the cooktop unit, so that, for example, the upper side of the cooktop unit and the upper side of the sill plate can be made to form a plane. The continuous height adjustment by means of screws means that the upper side of the cooking surface can be easily adjusted so that it is flush with the upper side of the sill plate without having to pay too close attention to the exact dimensions. The assembly can also be configured so that the cooking surface projects by a certain amount beyond the work surface or is recessed with respect to it.

Because the cooktop unit is flat, the adhesive connections that are provided to create the seal between the sill plate and the cooktop unit are exposed without protection to overflows of the food being cooked. The adhesive connections and the sealing areas, which are particularly sensitive, are also extremely difficult to clean. Some publications may describe the use of dark adhesive or sealing compounds, which are less likely to show the dirt.

Moreover, hot pots and pens can be unintentionally moved out of the actual cooking area onto the part of the cooktop unit where, in some embodiments, there are control and/or display elements, as a result of which said control and/or display elements can be damaged.

With a totally flat construction, it is also possible for the hot pots and pans to be unintentionally moved out of the actual cooking areas onto the work surface, which can damage the cooking surface, or even worse, because of the absence of any resistance provided by an edge, the hot pots and pans, plus their contents, can be unintentionally moved out of the working surface with unforeseeable consequences.

Some publications may also describe one-piece glass ceramic cooking surfaces, the outer peripheral area of which is either elevated or recessed on one side with respect to the main plane. German Patent Publication No. 196 10 073 A1 describes a glass ceramic cooking surface, which has at least one step, whereby the step is realized in the form of a sharp edge, which can be easily damaged by pots and pans or by cleaning devices such as the scrapers that are conventionally used to clean glass ceramic cooking surfaces.

A plate made of a material that is heat-permeable, such as glass ceramic, glass, ceramic or a similar material, and can be used as a surface for cooking, for example, is described in German Patent Publication No. 297 02 586 U1. The one-piece plate thereby forms two parallel planes at different heights.

A cooking and control surface made of a one-piece glass ceramic plate, in which the control surface is elevated and the cooking surface is located opposite it, is described in German Patent Publication No. 42 16 677 A1.

German Patent Publication No. 90 13 064 U1 describes a one-piece cooking area, with a working area made of ceramic material or glass ceramic, whereby the cooking area is provided with an elevated, essentially encircling edge.

A one-piece molded part made of glass, glass ceramic or ceramic as a heated surface is described in German Utility Model German Patent Publication No. 298 11 628.6, whereby the molded part forms at least the surface and one lateral surface that is bent downward.

German Patent Publication No. 43 33 334 A1 describes a plate that is made of glass ceramic as a component of a cooking unit, in which at least one area of the one-piece plate is on a plane that is different from the main plane. FIG. 7 in German Patent Publication No. 43 33 334 A1 shows a one-piece glass ceramic plate with an encircling outer peripheral area that is elevated with respect to the level of the inner main plane of the plate, in which the cooking zones are located. The radius diameters between the main plane and that of the elevated peripheral area claimed are from 4 mm to 100 mm.

OBJECT OF THE INVENTION

The object of the invention is to find an arrangement of a one-piece molded part made of glass ceramic, glass or ceramic, with an encircling outer peripheral area that is elevated with respect to the main plane, in a cutout of a sill plate which substantially eliminates the disadvantages and weaknesses of the constructions and embodiments of other cooktops or stoves, and is also substantially simple and economical to manufacture, as well as substantially simple and economical to install. An additional object of the invention is to find an arrangement that is substantially very easy to operate and clean, to inspect and maintain, and offers a substantially high degree of safety.

SUMMARY OF THE INVENTION

The present invention teaches the arrangement of a one-piece molded part made of glass ceramic, glass or ceramic as the cooking surface of a cooking unit in a cutout of a sill plate, with an elevated, encircling outer peripheral region that is on a level that is different from the level of the inner main level of the one-piece molded part, in which at least one cooking zone is located, whereby the one-piece molded part is inserted flush into the cutout of the sill plate, or, as disclosed, the arrangement of a one-piece molded part as described above, in which the one-piece molded part is laid by means of its encircling peripheral area on the periphery of the cutout of the sill plate.

In other words, "flush" may mean that the one-piece molded part is inserted into the cutout of the sill plate so that the encircling peripheral area of the one-piece molded part is level with the cutout of the sill plate and substantially no gap exists between the cutout of the sill plate and the one-piece molded part. Alternatively, "on the periphery of the cutout of the sill plate" may mean that the one-piece molded part is inserted into the cutout of the sill plate so that the encircling peripheral area of the one-piece molded part lies above the cutout of the sill plate, forming possibly an F-cut (in other words, a bevel cut) at both the front elevated peripheral area and the rear elevated peripheral area or possibly a C-cut (in other words, a rounded cut) at both the front elevated peripheral area and the rear elevated peripheral area.

As a result of this arrangement claimed by the invention and the use of the one-piece molded part, it becomes possible to substantially eliminate the use of the installation or protective frame that surrounds the molded part.

In other words, the raised encircling peripheral area may function as a barrier to substantially prevent hot cookware from being unintentionally moved from the inner main plane of the one-piece molded part, which is placed lower than the encircling peripheral area, over the control and/or display zone, which is placed on the encircling peripheral area and therefore at a higher level than the inner main plane of the one-piece molded part on which cookware may be located. Alternatively, the raised encircling peripheral area may function as a barrier to substantially prevent food being cooked from overflowing from the inner main plane of the one-piece molded part, where at least one cooking zone is located and which is placed lower than the encircling peripheral area, over the control and/or display zone, which is placed on the encircling peripheral area and is therefore at a higher level than the inner main plane of the one-piece molded part on which at least one cooking zone is located.

The molded part lies in or on the cutout of the sill plate. The advantages of the trough-shaped geometry of the molded part may be achieved in the simplest possible manner. The raised encircling peripheral area may simultaneously act as a frame and as the overflow protection, and also may act as an obstacle to prevent the unintentional pulling of hot pans away from the actual cooking surface. Because the encircling peripheral area of the one-piece molded part that functions as the frame are made of the same material as the inner cooking area, the entire one-piece molded part may be decorated in a uniform manner, with the same patterns and colors, thereby achieving a substantially harmonious visual appearance. Because there is no separate frame that is made of a different material, and because no frame needs to be glued in place, it is possible to use less material and to eliminate steps in the manufacturing and installation process. Because the one-piece molded part lies by means of its encircling peripheral area on an installation frame that is connected with the cutout of the sill plate, and the height of the molded part can be continuously adjusted, additional advantageous potential arrangements of the molded part with respect to the sill plate can be realized. If desired, the arrangement can be one in which the surface of the encircling peripheral area is elevated or recessed by a certain amount with respect to the surface of the sill plate.

In other words, there may be no need for the installation of a frame separate from the one-piece molded part because the encircling peripheral area may function as a barrier to substantially prevent food being cooked from overflowing onto the sill plate or onto the control and/or display zone. Alternatively, there may be no need for the installation of a frame separate from the one-piece molded part because the encircling peripheral area may function as a barrier to substantially prevent cookware from being unintentionally moved from the inner main plane of the one-piece molded part to the sill plate or to the control and/or display zone.

In one particularly advantageous arrangement, the upper side of the sill plate and the upper side of the encircling peripheral area of the one-piece molded part form a plane.

In other words, in one particularly advantageous arrangement, the top side of the sill plate and the top side of the encircling peripheral area of the one-piece molded part may be level with each other.

The one-piece molded part can have a cut, in particular a flat facet or C-cut on its outer edge. This configuration is particularly advantageous if the surface of the encircling peripheral area of the one-piece molded part is higher than the surface of the sill plate. In this arrangement, the outer edge is partly or entirely exposed. By grinding or polishing the outer edge, a substantially significant increase of the resistance to fracture or breaking may be achieved in the vicinity of the edges, and at the same time a transition area may be created between the sill plate and the molded part. Because the outer edge is ground or polished, the danger that the user might cut himself or herself on this edge is also substantially eliminated.

The inner main plane of a one-piece molded part, in which there is at least one cooking zone, is recessed in the manner of a trough with respect to the encircling peripheral area, in particular by approximately 2 mm to 4 mm.

The inner main plane of the one-piece molded part and the encircling peripheral area may have substantially large transition radii to one another, in particular transition radii from approximately 10 mm to 50 mm.

Because the transition area between the recessed inner area and the elevated outer area is essentially very soft and may be realized with large radii, and the inner main plane is recessed, in particular by approximately 2 mm to 4 mm, there is a substantially noticeable resistance when cookware is pulled across it, but essentially no sharp edges that can be damaged.

The inner, recessed main plane can have areas that are elevated and or further recessed, whereby the areas in question, if they are flat, can be associated with individual cooking zones. The advantages described above may result from the fact that the transition area likewise may have large transition radii, in particular transition radii of approximately 10 mm to 50 mm.

In other words, it is possible to use as one embodiment of the invention a one-piece molded part, the inner main plane of which has areas that are elevated or recessed relative to the level of the largest planar portion of the inner main plane, and the flat surfaces of which inner main plane may be associated with cooking zones.

The encircling peripheral area can in particular be approximately 20 mm to 80 mm wide.

In other words, in one possible embodiment of the present invention, the front peripheral area and the back peripheral area may each be approximately 80 mm wide at the widest point of each of these structures, and each of the lateral peripheral areas may be approximately 20 mm wide.

The connecting points of the one-piece molded part, where it forms a seal with the sill plate, may be arranged so that they are not exposed to high temperatures, nor can they be reached by overflowing food being cooked. This measure can be achieved substantially easily and effectively by means of a relatively wide, encircling peripheral area.

The one-piece molded part can be glued substantially fluid-tight with the sill plate and also, if necessary, with the installation frame, in particular by means of a silicone adhesive. The adhesive points are located on the outermost encircling peripheral area outside the hot cooking area, and thus may not be exposed either to particularly high temperatures, or to spilled or overflowing food being cooked. The risk of a permanent and severe staining of the adhesive and sealing points is significantly minimized. It is therefore possible to use even light-colored adhesives, e.g. adhesives that match the color of the sill plate. In addition, these adhesives may no longer need to be particularly resistant to high temperatures.

The recessed inner cooking area can be filled with a little water for cleaning, and the water can also be heated by turning on the heating elements. It thereby becomes possible to soften dried-on, baked-on dirt and to remove it without significantly damaging the decoration or the surface. This measure represents a significant improvement in the cleanability of the cooktop.

The encircling peripheral area of the one-piece molded part can be substantially asymmetrical, or it can be substantially symmetrical only on opposite sides.

In other words, in one possible embodiment of the present invention, the lateral elevated peripheral areas may be of substantially different widths relative to each other, and the front elevated peripheral area and the rear elevated peripheral area may be of substantially different widths relative to each other. In another possible embodiment of the present invention, each of the lateral elevated peripheral areas, which are located opposite each other, may be of substantially similar width relative to each other, and the front elevated peripheral area and the rear elevated peripheral area, which are located opposite each other, may be of substantially similar width relative to each other.

The one-piece molded part can be realized in the form of a cooking surface and/or a frying surface for cooking units that are heated by electricity and/or gas and/or solid fuel and/or by induction.

At least one control and/or display zone is preferably associated with the encircling peripheral area of the one-piece molded part. The control and/or display zone can thereby be located to special advantage on the forward peripheral area or on the lateral peripheral area of the one-piece molded part. It is also possible to place the controls and displays in the rear peripheral area, which is preferred in some countries. It thereby becomes possible to achieve a particularly high degree of ease of operation, control and safety. The control and display zone is located on the raised encircling peripheral area, and thus may be exposed neither to high temperatures nor to the cooking zone itself, and the unintentional misplacement of hot cookware or any overflows of the food being cooked are essentially prevented by the recessed inner main plane.

In other words, the raised encircling peripheral area may function as a barrier to substantially prevent hot cookware from being unintentionally moved from the inner main plane of the one-piece molded part, which is placed lower than the encircling peripheral area, over the control and/or display zone, which, in one possible embodiment of the present invention, is located on the encircling peripheral area and is therefore at a higher level than the inner main plane of the one-piece molded part on which cookware may be. Alternatively, the raised encircling peripheral area may function as a barrier to substantially prevent food being cooked from overflowing from the inner main plane of the one-piece molded part, where at least one cooking zone is located and which is placed lower than the encircling peripheral area, over the control and/or display zone, which, in one possible embodiment of the present invention, is located on the encircling peripheral area and is therefore at a higher level than the inner main plane of the one-piece molded part on which at least one cooking zone is located.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintain that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The invention is explained in greater detail below with reference to the exemplary embodiments that are illustrated in the accompanying figures.

DESCRIPTION OF THE PREFERRED EMBODIMENT

Figure 1:
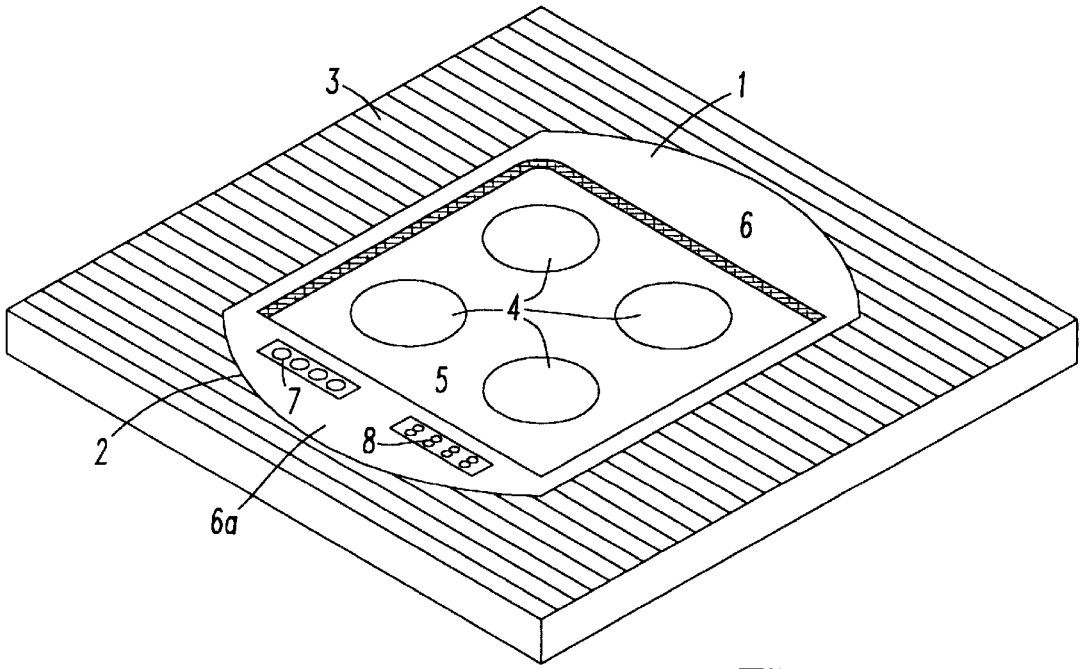
FIG. 1 is a view in perspective of a flush arrangement of a one-piece, trough-shaped molded part made of glass ceramic as the cooktop of a cooking device in a cutout of a sill plate.

FIG. 1 shows an arrangement of a one-piece molded part 1 made of glass ceramic as claimed by the invention, which is used as the cooking surface of a cooking unit in a cutout 2 of a sill plate 3, and has an elevated, encircling outer peripheral area 6 that is higher than the level of an inner main plane 5 of the one-piece molded part 1, in which there are four cooking zones 4, whereby the molded part 1 is inserted flush into the cutout 2 of the sill plate 3. On a raised front peripheral area 6a of the molded part 1, underneath the surface of the molded part 1, there are a control zone 7 with control elements, e.g. infrared touch panels, and a display zone 8 with display elements, e.g. light-emitting diodes, in particular seven-segment displays or bar graph displays, located under the surface of the molded part. In the illustrated embodiment, the encircling peripheral area 6 is realized symmetrically on the respective opposite sides, whereby the front elevated peripheral area 6*a* and the rear elevated peripheral area are wider than the two lateral elevated peripheral areas.

Figure 2:
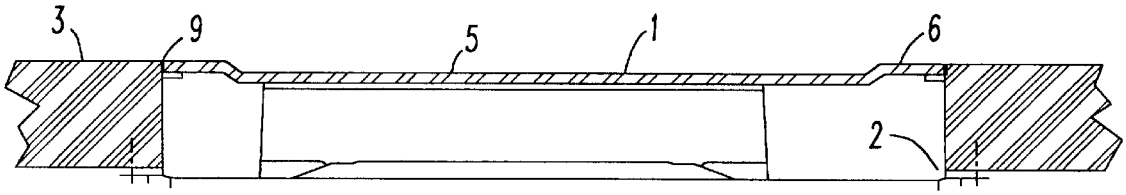
FIG. 2 is a flush arrangement of a one-piece, trough-shaped molded part made of glass ceramic in a cutout of a sill plate.

FIG. 2 shows an arrangement of the molded part 1 described above made of glass ceramic. The molded part 1 is inserted flush into the cutout 2 of the sill plate 3. The upper side of the sill plate 3 and the upper side of the encircling peripheral area 6 of the one-piece molded part 1 form a plane. The inner main plane 5 of the molded part is trough-shaped, in particular recessed by approximately 2 mm to 4 mm. The surface of the encircling peripheral area 6 and the inner main plane 5 are preferably oriented parallel to each other. The transition area between the inner main plane and the encircling peripheral area may be realized with large transition radii, in particular with radii of approximately 10 mm to 50 mm. The encircling peripheral area 6 is preferably 20 mm to 80 mm wide. The sealed connecting points between the one-piece molded part 1 and the sill plate 3 are located so that because of their relatively great distance from the hot cooking zone, they are essentially not exposed to high temperatures, and because of the recessed cooking area, they essentially cannot be reached by overflows of the food being cooked. The molded part 1 is connected substantially fluid-tight with the sill plate 3 on the lateral edge, and if necessary also on the lower outside edge of the molded part 1, by means of an adhesive, in particular a silicone adhesive 9.

Figure 3:
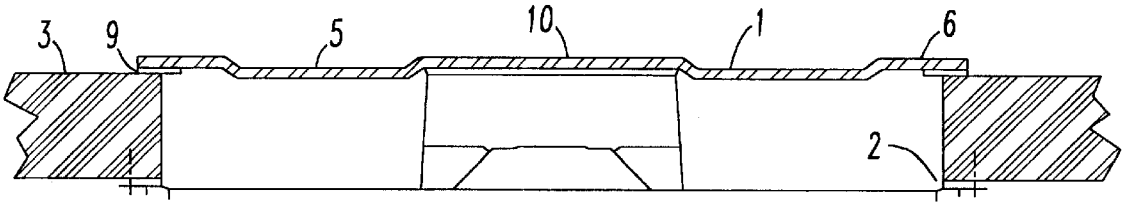
FIG. 3 is an arrangement of a one-piece trough-shaped molded part made of glass ceramic, whereby the molded part lies by means of its encircling peripheral area on the periphery of the cutout of the sill plate, and the outer edge of the molded part has a facet cut.
Figure 4:
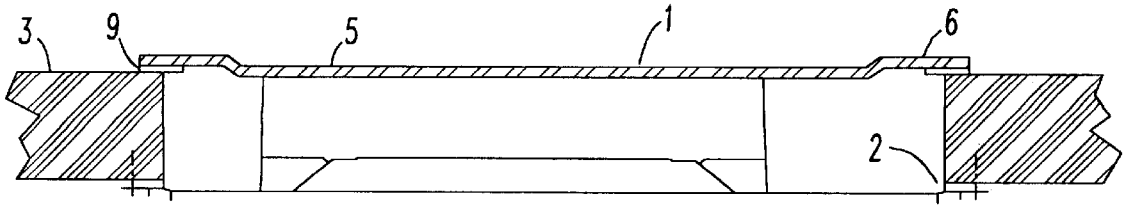
FIG. 4 is an arrangement as illustrated in FIG. 3, whereby the o edge of the molded part has a C-cut.

FIGS. 3 and 4 show an arrangement of the one-piece molded part 1 described above, whereby the molded part lies by means of its encircling peripheral area 6 on the periphery of the cutout 2 of the sill plate 3, and is connected with the outer periphery of the molded part in a fluid-tight connection by means of the silicone adhesive 9. The molded part illustrated in FIG. 3 has a flat facet cut, and the molded part illustrated in FIG. 4 has a C-cut, which preferably act as edge-guards.

In FIG. 3, an elevated area la of the inner, recessed main plane 5 is associated with a cooking zone. The flat, elevated area 1*a* thereby has substantially the same transition radii to the recessed main plane 5 as the encircling peripheral area 6. The surface of the encircling peripheral area 6 and the surface of the elevated area 1*a* are preferably realized so that their surfaces lie in the same plane.

Figure 5:
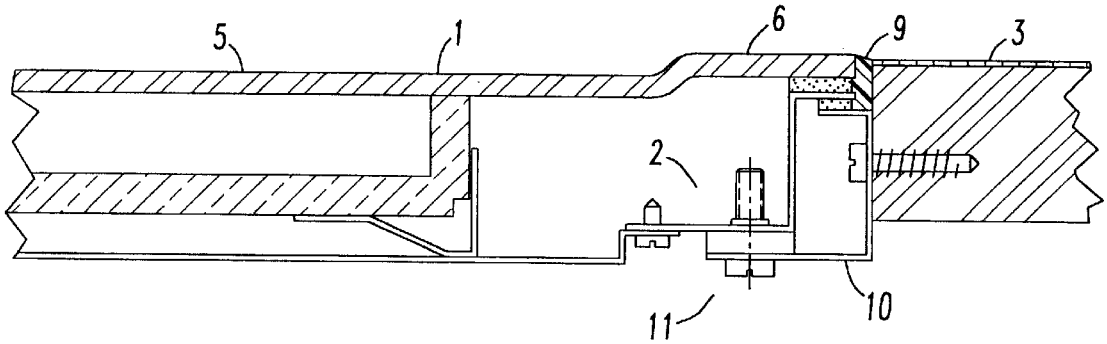
FIG. 5 an arrangement as illustrated in FIG. 1, whereby the molded part lies by means of its encircling peripheral area on an installation frame that is connected with the cutout of the sill plate, and the height of the molded part is continuously adjustable.

FIG. 5 shows the arrangement of the one-piece molded part 1 described above, which lies by means of its encircling peripheral area 6 on an assembly frame 10, which is itself described by German Patent Publication No. 30 09 961 C2, and is connected with the cutout 2 of the sill plate 3. The height of the molded part 1 can be continuously adjusted by means of screws 11. The molded part 1, on its outer edge, has a C-cut, and is connected substantially fluid-tight with the sill plate 3 by means of a silicone adhesive 9. The surface of the encircling peripheral area 6 thereby lies somewhat higher than the surface of the sill plate 3.

One feature of the invention resides broadly in the arrangement of a one-piece molded part made of glass ceramic, glass or ceramic as the cooking surface of a cooking unit in a cutout of a sill plate, with an elevated, encircling outer peripheral region that is different from the level of the inner main level of the one-piece molded part, in which at least one cooking zone is located, characterized by the fact that the one-piece molded part is inserted flush into the cutout of the sill plate.

Another feature of the invention resides broadly in the arrangement of a one-piece molded part made of glass ceramic, glass or ceramic as the cooking surface of a cooking unit in a cutout of a sill plate, with an elevated, encircling outer peripheral region that is different from the level of the inner main level of the one-piece molded part, in which at least one cooking zone is located, characterized by the fact that the one-piece molded part lies by means of its encircling peripheral area on the edge of the cutout of the sill plate.

Yet another feature of the invention resides broadly in the arrangement characterized by the fact that the one-piece molded part lies by means of its encircling peripheral area on an installation frame that is connected with the cutout of the sill plate, and the height of the one-piece molded part can be adjusted substantially continuously.

Still another feature of the invention resides broadly in the arrangement characterized by the fact that the upper side of the sill plate and the upper side of the encircling peripheral area of the one-piece molded part form a plane.

A further arrangement characterized by the fact that the one-piece molded part, on the outer edge of the encircling peripheral area, has a cut, in particular a flat facet or C-cut.

Another feature of the invention resides broadly in the arrangement characterized by the fact that the inner main plane of the one-piece molded part, in which there is at least one cooking zone, is recessed in the manner of a trough with respect to the peripheral area, in particular by approximately 2 mm to 4 mm.

Yet another feature of the invention resides broadly in the arrangement characterized by the fact that the inner main plane and the encircling peripheral area have substantially large transition radii to each other, in particular transition radii from approximately 10 mm to 50 mm.

Still another feature of the invention resides broadly in the arrangement characterized by the fact that the inner main plane has areas that are elevated and recessed.

A further feature of the invention resides broadly in the arrangement characterized by the fact that the inner main plane and the elevated or recessed areas have substantially large transition radii to one another, in particular transition radii of approximately 10 mm to 50 mm.

Another feature of the invention resides broadly in the arrangement characterized by the fact that the encircling peripheral area is approximately 20 mm to 80 mm wide.

Yet another feature of the invention resides broadly in the arrangement characterized by the fact that the connecting parts of the one-piece molded part that seal it with the sill plate are arranged so that they are substantially neither exposed to elevated temperatures nor can they be reached by overflows or spills of the food being cooked.

Still another feature of the invention resides broadly in the arrangement characterized by the fact that the one-piece molded part is connected substantially fluid-tight with the sill plate and, if necessary, with the assembly frame by means of an adhesive, in particular a silicone adhesive.

A further feature of the invention resides broadly in the arrangement characterized by the fact that the encircling peripheral area of the one-piece molded part is substantially asymmetrical or is substantially symmetrical only on opposite sides.

Another feature of the invention resides broadly in the arrangement characterized by the fact that the one-piece molded part may be used as a cooking surface and/or frying surface for cooking units heated by electricity and/or gas and/or solid fuel and/or by induction.

Yet another feature of the invention resides broadly in the arrangement characterized by the fact that associated with the encircling peripheral area of the one-piece molded part, there is at least one control and/or display zone.

Still another feature of the invention resides broadly in the arrangement characterized by the fact that the control and/or display zone is located in the front peripheral area of the one-piece molded part.

A further feature of the invention resides broadly in the arrangement characterized by the fact that the control and/or display zone is located in the lateral peripheral area of the one-piece molded part.

Some examples of ceramic materials that may possibly be utilized or adapted for use in the context of the present invention may be disclosed in the following U.S. Pat. No. 5,385,873, issued on Jan. 31, 1995; U.S. Pat. No. 5,407,740, issued on Apr. 18, 1995; U.S. Pat. No. 5,420,399, issued on May 30, 1995; U.S. Pat. No. 5,422,319, issued on Jun. 6, 1995; U.S. Pat. No. 5,449,649, issued on Sep. 12, 1995; U.S. Pat. No. 5,476,684, issued on Dec. 19, 1995; and U.S. Pat. No. 5,691,261, issued on Nov. 25, 1997.

Some examples of ceramic plates that may possibly be utilized or adapted for use in the context of the present invention may be disclosed in the following U.S. Pat. No. 3,596,650, issued on Aug. 3, 1971; U.S. Pat. No. 3,870,861, issued on Mar. 11, 1975; U.S. Pat. No. 4,414,465, issued on Nov. 8, 1983; U.S. Pat. No. 4,634,841, issued on Jan. 6, 1987; and U.S. Pat. No. 5,397,873, issued on Mar. 14, 1995.

Some examples of cooktops that may possibly be utilized or adapted for use in the context of the present invention may be disclosed in the following U.S. Pat. No. 5,679,273, issued on Oct. 21, 1997; U.S. Pat. No. 5,406,932, issued on Apr. 18, 1995; U.S. Pat. No. 5,422,460, issued on Jun. 6, 1995; U.S. Pat. No. 5,424,512, issued on Jun. 13, 1995; U.S. Pat. No. 5,425,353, issued on Jun. 20, 1995; U.S. Pat. No. 5,429,114, issued on Jul. 4, 1995; and U.S. Pat. No. 5,448,036, issued on Sep. 5, 1995.

Some examples of adhesive materials that may possibly be utilized or adapted for use in the context of the present invention may be disclosed in the following U.S. Pat. U.S. Pat. No. 5,225,662, issued on Jul. 6, 1993; U.S. Pat. No. 5,268,338, issued on Dec. 7, 1993; U.S. Pat. No. 5,288,674, issued on Feb. 22, 1994; U.S. Pat. No. 5,300,627, issued on Apr. 5, 1994; U.S. Pat. No. 5,403,228, issued on Apr. 4, 1995; U.S. Pat. No. 5,432,320, issued on Jul. 11, 1995; U.S. Pat. No. 5,468,290, issued on Nov. 21, 1995; and U.S. Pat. No. 5,475,044, issued on Dec. 12, 1995.

Some further examples of cooktops that may possibly be utilized or adapted for use in the context of the present invention may be disclosed in the following U.S. patent application Ser. No. 09/022,466, having Attorney Docket No. SCT-01 US, filed on Feb. 12, 1998, entitled "COOKING UNIT, SUCH AS A STOVE, FOR COOKING FOOD", having inventors Martin Taplan, Herwig Scheidler, and Christof Koster, which may or will claim priority from German Patent Publication 197 05 715.2-16, which was filed on Feb. 14, 1997; Ser. No. 09/022,918, having Attorney Docket No. SCT-03 US, filed on Feb. 12, 1998, entitled "COOKING APPLIANCE, SUCH AS A STOVE, WITH A GLASS-CERAMIC HOB OR COOKTOP WITH A RAPID COOKING RING OR HOTPLATE", having inventors Dr. Peter Nass, Dr. Patrick Hoyer, and Dr. Kurt Schaupert, which may or will claim priority from German Patent Publication DE 297 02 418.3, which was filed on Feb. 13, 1997; Ser. No. 09/177,336, having Attorney Docket No. SCT-04 US, filed on Oct. 22, 1998, entitled "COOKING APPLIANCE SUCH AS A STOVE WITH AN ARRANGEMENT FOR A CERAMIC HEATING ELEMENT AS A COOKING ZONE IN A CUTOUT OF A COOKING SURFACE", having inventor Bernd Schultheis, which may or will claim priority from German Patent Publication P 197 46 844.6, which was filed on Oct. 23, 1997; Ser. No. 09/176,981, Attorney Docket No. SCT-05 US, filed on Oct. 22, 1998, entitled "ARRANGEMENT OF A HOT PLATE IN A COOK TOP", having inventors Bernd Schultheis and Martin Taplan, which may or will claim priority from German Patent Publication P 197 46 845.4, filed on Oct. 23, 1997; and Ser. No. 09/364,479, Attorney Docket No. SCT-06 US, filed on Jul. 30, 1999, entitled "LEAD- AND CADMIUM-FREE GLASS COMPOSITION FOR GLAZING, ENAMELLING AND DECORATING GLASSES OR GLASS-CERAMICS, AND PROCESS FOR THE PRODUCTION OF A GLASS-CERAMIC COATED THEREWITH", having the inventors Ina Mitra, Dr. Friedrich Siebers, Dr. Jutta Reichert, Dr. Cora Krause, Dr. Otmar Becker, and Dr. Michael Bug, which may or will claim priority from German Patent Publication DE 198 34 801.0-45, filed on Aug. 1, 1998.

The components disclosed in the various publications, disclosed or incorporated by reference herein, may be used in the embodiments of the present invention, as well as equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. 198 48 908.0-16, filed on Oct. 23, 1999, having inventors Helga Götz, Karl-Heinz Juras, Stefan Hubert and Dr. Hubertus-Christian Bader, and DE-OS 198 48 908.0-16 and DE-PS 198 48 908.0-16 as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

NOMENCLATURE

1. One-piece molded part

1*a*. Elevated area

2. Cutout of a sill plate
3. Sill plate
4. Cooking zones
5. Inner main plane of the one-piece molded part
6. Outer peripheral are of the one-piece molded part
6*a*. Front outer peripheral part
7. Control zone
8. Display zone
9. Silicone adhesive
10. Installation frame
11. Screws

What is claimed is:

1. An arrangement including a cooking unit, said arrangement comprising:

a sill plate;

said sill plate being configured with a cutout therein; and a one-piece molded part made of glass ceramic, glass or ceramic as the cooking surface of said cooking unit;

said one-piece molded part being disposed in said cutout of said sill plate;

said one-piece molded part comprising an inner main portion;

at least one cooking zone;

said at least one cooking zone being operatively disposed at said inner main portion of said one-piece molded part to provide heat to said inner main portion of said one-piece molded part;

said one-piece molded part further comprising an elevated, encircling outer peripheral portion that is different from the level of said inner main portion of said one-piece molded part and completely encircling said inner main portion of said one-piece molded part;

said peripheral portion being configured to prevent cooking receptacles to be moved from said inner main portion of said one-piece molded part onto said outer peripheral portion and to prevent cooking spillage to reach said outer peripheral portion;

wherein the one-piece molded part is inserted flush into the cutout of the sill plate.

2. The arrangement as claimed in claim 1 wherein said elevated, encircling outer peripheral portion of said one-piece molded part comprises an upper surface which is substantially continuous and level with the upper surface of said sill plate.

3. The arrangement as claimed in claim 2 wherein said sill plate completely surrounds said one-piece molded part.

4. An arrangement including a cooking unit, said arrangement comprising:

a sill plate;

said sill plate being configured with a cutout therein; and a one-piece molded part made of glass ceramic, glass or ceramic as the cooking surface of said cooking unit;

said one-piece molded part being disposed in said cutout of said sill plate;

said one-piece molded part comprising an inner main portion;

at least one cooking zone;

said at least one cooking zone being operatively disposed at said inner main portion of said one-piece molded part to provide heat to said inner main portion of said one-piece molded part;

said one-piece molded part further comprising an elevated, encircling outer peripheral portion that is different from the level of said inner main portion of said one-piece molded part and completely encircling said inner main portion of said one-piece molded part;

said peripheral portion being configured to prevent cooking receptacles to be moved from said inner main portion of said one-piece molded part onto said outer peripheral portion and to prevent cooking spillage to reach said outer peripheral portion;

wherein the one-piece molded part is positioned by means of its encircling peripheral portion on the upper edge of the cutout of the sill plate.

5. The arrangement as claimed in claim 1, wherein the one-piece molded part lies by means of its encircling peripheral portion on an installation frame that is connected with the cutout of the sill plate, and the height of the one-piece molded part can be adjusted continuously.

6. The arrangement as claimed in claim 5, wherein the upper side of the sill plate and the upper side of the encircling peripheral portion of the one-piece molded part form a plane.

7. The arrangement as claimed in claim 5, wherein the one-piece molded part, on the outer edge of the encircling peripheral portion, has a cut, in particular a flat facet or C-cut.

8. The arrangement as claimed in claim 7, wherein the inner main portion of the one-piece molded part, in which there is at least one cooking zone, is recessed in the manner of a trough with respect to the peripheral portion, in particular by 2 mm to 4 mm.

9. The arrangement as claimed in claim 8, wherein the inner main portion and the encircling peripheral portion have large transition radii to each other, in particular transition radii from 10 mm to 50 mm.

10. The arrangement as claimed in claim 9, wherein the inner main portion has areas that are elevated and recessed.

11. The arrangement as claimed in claim 10, wherein the inner main portion and the elevated or recessed areas of said inner main portion have large transition radii to one another, in particular transition radii of 10 mm to 50 mm.

12. The arrangement as claimed in claim 11, wherein the encircling peripheral portion is 20 mm to 80 mm wide.

13. The arrangement as claimed in claim 12, wherein connecting parts of the one-piece molded part that seal it with the sill plate are arranged so that they are neither exposed to elevated temperatures nor can they be reached by overflows or spills of the food being cooked.

14. The arrangement as claimed in claim 13, wherein the one-piece molded part is connected fluid-tight with the sill plate and, if necessary, with the installation frame by means of an adhesive, in particular a silicone adhesive.

15. The arrangement as claimed in claim 14, wherein the encircling peripheral portion of the one-piece molded part is asymmetrical or is symmetrical only on opposite sides.

16. The arrangement as claimed in claim 15, wherein the one-piece molded part is used as a cooking surface and/or frying surface for cooking units heated by electricity and/or gas and/or solid fuel and/or by induction.

17. The arrangement as claimed in claim 16, wherein associated with the encircling peripheral portion of the one-piece molded part, there is at least one control and/or display zone.

18. The arrangement as claimed in claim 17, wherein the control and/or display zone is located in the front peripheral area of the one-piece molded part.

19. The arrangement as claimed in claim 17, wherein the control and/or display zone is located in the lateral peripheral area of the one-piece molded part.

20. An arrangement including a cooking unit, said arrangement comprising:

a sill plate;

said sill plate being configured with a cutout therein; and a one-piece molded part made of glass ceramic, glass or ceramic as the cooking surface of said cooking unit;

said one-piece molded part being disposed in said cutout of said sill plate;

said one-piece molded part comprising an inner main portion;

at least one cooking zone;

said at least one cooking zone being operatively disposed at said inner main portion of said one-piece molded part to provide heat to said inner main portion of said one-piece molded part;

said one-piece molded part further comprising an elevated, encircling outer peripheral portion that is different from the level of said inner main portion of said one-piece molded part and completely encircling said inner main portion of said one-piece molded part;

said peripheral portion being configured to prevent cooking receptacles to be moved from said inner main portion of said one-piece molded part onto said outer peripheral portion and to prevent cooking spillage to reach said outer peripheral portion;

wherein said one-piece molded part is inserted flush into said sill plate;

said elevated, encircling outer peripheral portion of said one-piece molded part comprising an upper surface which is substantially continuous and level with the upper surface of said sill plate;

said sill plate completely surrounding said one-piece molded part;

said one-piece molded part being disposed by means of its encircling peripheral portion on an installation frame that is connected with the cutout of the sill plate, and the height of the one-piece molded part can be adjusted continuously;

wherein the upper side of the sill plate and the upper side of the encircling peripheral portion of the one-piece molded part form a plane;

said one-piece molded part, on the outer edge of the encircling peripheral portion, having a cut, in particular a flat facet or C-cut;

said inner main portion of the one-piece molded part, in which there is at least one cooking zone, is recessed in the manner of a trough with respect to the peripheral portion, in particular by 2 mm to 4 mm;

said the inner main portion and the encircling peripheral portion being configured with large transition radii to each other, in particular transition radii from 10 mm to 50 mm;

said inner main portion comprising areas that are elevated and recessed;

said inner main portion and the elevated or recessed areas of said inner main portion comprising large transition radii to one another, in particular transition radii of 10 mm to 50 mm;

said the encircling peripheral portion being 20 mm to 80 mm wide;

said one-piece molded part comprising connecting parts that seal said one-piece molded part with the sill plate, said connecting parts being disposed so that they are neither exposed to elevated temperatures nor can they be reached by overflows or spills of the food being cooked;

said one-piece molded part being connected substantially fluid-tight with the sill plate and, if necessary, with the installation frame by means of an adhesive, in particular a silicone adhesive;

said encircling peripheral portion of the one-piece molded part being configured asymmetrical or being symmetrical only on opposite sides;

said one-piece molded part being configured to being used as a cooking surface and/or frying surface for cooking units heated by electricity and/or gas and/or solid fuel and/or by induction; and at least one control and/or display zone being associated with said encircling peripheral portion of the one-piece molded part.

* * * * *

UNITED STATES PATENT AND TRADEMARK OFFICE

CERTIFICATE OF CORRECTION

PATENT NO. : 6,236,024 B1 
DATED : May 22, 2001
INVENTOR(S) : Helga Gotz, Stefan Hubert, Karl-Heinz Juras, and Hubertus-Christian Bader It is certified that error appears in the above-identified patent and that said Letters Patent is hereby corrected as shown below:

Column 1,
Line 47, after "and" delete "pens" and substitute -- pans --.

Column 6,
Line 37, after the first occurrence of "the" delete "o" and substitute -- outer --.

Column 9,
Line 30, after "following" delete "U.S. Pat.".

Signed and Sealed this

Twelfth Day of March, 2002

*Attest:*

*Attesting Officer*

JAMES E. ROGAN
*Director of the United States Patent and Trademark Office*